US007946912B1

(12) United States Patent
Rennard

(10) Patent No.: US 7,946,912 B1
(45) Date of Patent: May 24, 2011

(54) ROULETTE SYSTEM

(76) Inventor: Carl J Rennard, Lincoln, RI (US)

( * ) Notice: Subject to any disclaimer, the term of this patent is extended or adjusted under 35 U.S.C. 154(b) by 249 days.

(21) Appl. No.: 11/414,956

(22) Filed: May 1, 2006

(51) Int. Cl.
*A63F 9/24* (2006.01)

(52) U.S. Cl. ..... 463/17; 463/16; 273/138.1; 273/139; 273/142 R; 273/274

(58) Field of Classification Search ..... 463/1, 14, 463/16–17, 20–21, 23, 25–27, 29–34; 273/142, 273/138.1, 139, 142 B, 142 A, 142 HA, 142 J, 273/142 R, 148 R, 148 B, 274, 304, 309; *A63F 9/24*
See application file for complete search history.

(56) References Cited

U.S. PATENT DOCUMENTS 4,053,868 A * 10/1977 Cox et al. ..... 340/461
4,357,015 A * 11/1982 Santora et al. ..... 463/22
4,396,193 A * 8/1983 Reinhardt et al. ..... 463/22
4,643,425 A * 2/1987 Herzenberger ..... 463/17
4,792,137 A * 12/1988 McKechnie ..... 463/22
4,869,505 A * 9/1989 Manabe ..... 463/22
5,588,650 A * 12/1996 Eman et al. ..... 273/142 B
5,707,139 A * 1/1998 Haitz ..... 362/231
5,743,798 A * 4/1998 Adams et al. ..... 463/17
5,770,533 A * 6/1998 Franchi ..... 463/42
5,801,766 A * 9/1998 Alden ..... 348/157
5,836,583 A * 11/1998 Towers ..... 273/142 B
5,857,909 A * 1/1999 Rubin ..... 463/17
6,007,426 A * 12/1999 Kelly et al. ..... 463/16

* cited by examiner

*Primary Examiner* — Peter DungBa Vo
*Assistant Examiner* — Arthur O. Hall
(74) *Attorney, Agent, or Firm* — Turning Point Law, Inc.

(57) ABSTRACT

A gaming system for games, including roulette, wherein a projection system, preferably with a laser, is utilized for illuminating selected areas of the roulette game table in order to highlight the winning bets, enhance security, provide for a consistent signal for closing of the betting period, provide advertising, and/or display messages at selected time during or between play of the game determined by sensing the motion of the wheel and/or ball and table activity.

10 Claims, 2 Drawing Sheets

ROULETTE SYSTEM

BACKGROUND OF THE INVENTION

This invention relates to the field of roulette and other casino oriented table games where wagering occurs. Roulette is one of the most popular and well-known casino games steeped in tradition and excitement. In such game, a wheel with colored and numbered areas, e.g., depressions, delineated cages, etc., is spun on its vertical axis after which a ball is introduced upon the moving rotating wheel surface until the ball ultimately comes to rest upon one of such numbered areas.

It is well recognized that as the wheel slows in speed and the movement of the ball moving and/or bouncing along the wheel's surface slows as well, observers, e.g., those bettors playing the game, have a better idea, that is, heightened odds, of choosing which of the numbered or colored areas the ball will ultimately come to rest upon thus determining the winner. The casino employee, dealer or croupier overseeing the table normally controls the movement when no more bets may be placed on the outcome of where the ball will rest and this call or decision is made on the basis of experience and judgment and preferably before the wheel slows to a point where the players can see where or which area of the wheel the ball is going to ultimately rest upon. In other words, the dealer or croupier that is overseeing the table has to not only judge when to terminate further betting based on the speed of the rotating wheel and to some extent the speed and other ball movement, but the croupier must also rule as to whether or not any of the players, i.e., bettors, have improperly placed or withdrawn bets after the "No More Bets" verbal announcement is made. The croupier thus has to observe the ball, the wheel, their relative speeds and movements as well as simultaneously observe whether any bets were made, withdrawn or modified after the "No More Bets" announcement was made.

Although croupiers are skilled, the above duties are demanding and should be carried out in a professional but exciting manner that lends enjoyment to the overall wagering experience. It would, accordingly, be advantageous to provide a system which assists the croupier in his or her duties, e.g., one that would match the wheel's speed to a predetermined speed based on prior experience to a programmed "No More Bets" announcement by a recorded voice or other signal and/or an audible or visual cue to the croupier to make the No More Bets" announcement. Such a system would reduce the croupier's work load, and the casino management could better control the odds by selecting the predetermined wheel speed level at which the "No More Bets" announcement would be made, e.g., the higher the wheel speed, the less likely players could get any feel for where the ball was going thus increasing the odds or at least moving the odds to a point of pure change and vice versa by lowering the predetermined wheel speed.

Another feature of a casino style roulette table is that there is a designated betting area generally rectangular in shape and with a defined perimeter and divided with generally square or rectangular betting areas corresponding to the roulette wheel's numbers and colors and on which betting areas the players place chips in order to register their bets on the outcome of the wheel spin. The players sit adjacent this betting area while the croupier generally sits or stands across from the players and the wheel at the other tableside. Players may place, modify or remove chips at any time prior to the "No More Bets" call by either having the croupier do so or by actually moving their hands across the periphery of the betting area and manipulating the chips into or away from the individual betting areas. Obviously, the croupier has to closely monitor these player actions and be sure no betting takes place after the "No More Bets" call. Thus, anything that would help the croupier perform this duty would be beneficial.

As previously indicated, roulette is a traditional game and actual physical changes to the wheel, the ball or the manner the game is played probably would not be well received; however, features which could add excitement, inform the players about current or upcoming casino events or simply pure advertising that does not interfere with the playing of each wheel spin would generally be welcomed by the players and beneficial to the casino especially if such included paid advertisements. Thus, devising an information and advertisement roulette feature would be advantageous to both the players and the casino as well.

It is, therefore, an object of the present invention to provide a hardware and operational system that addresses the above-indicated concerns to improve the croupier's consistency and monitoring performance and add excitement to the game without detracting from its tradition.

It is also another object of the present invention to incorporate means for determining the ball and/or wheel speed in roulette gaming and to utilize such means in a system for announcing the "No More Bets" cut off.

A still further object of the present invention is to correlate the traditional oral "No More Bets" announcement with a visible announcement display on the betting table itself.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENT

Figure 1:
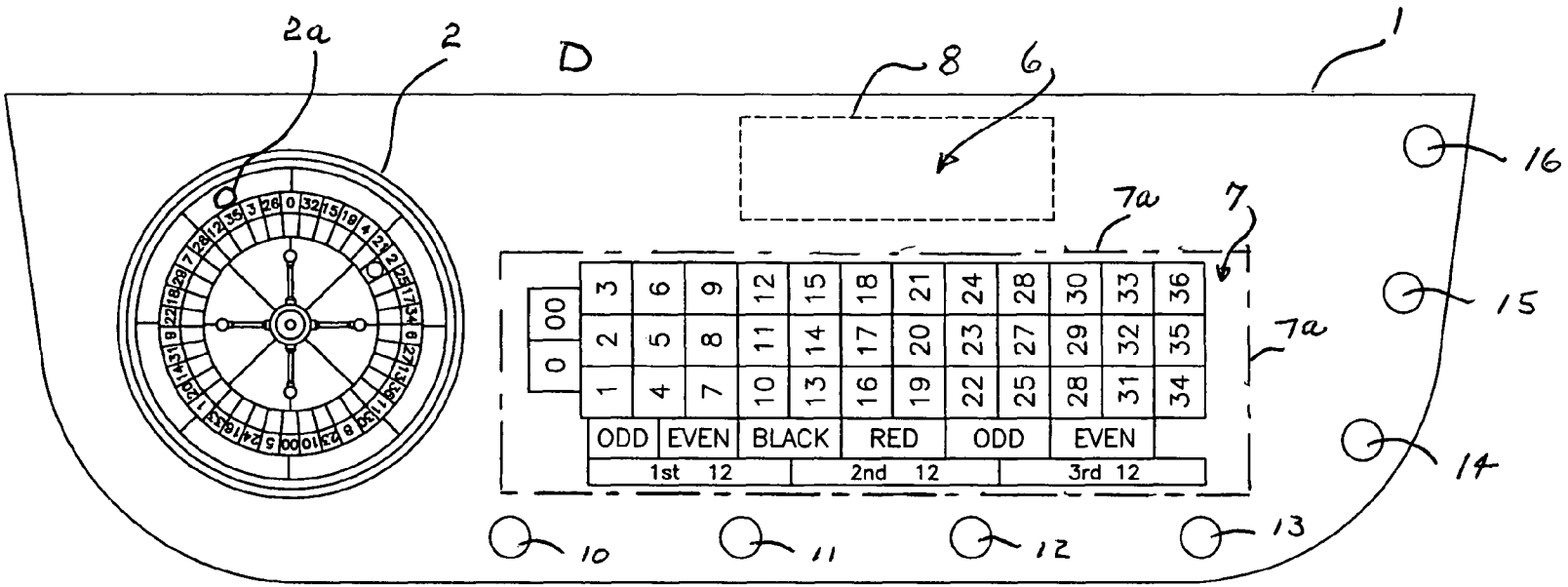
FIG. 1 is a stylized top plan view of a roulette table and wheel incorporating the features of the present invention.
Figure 2:
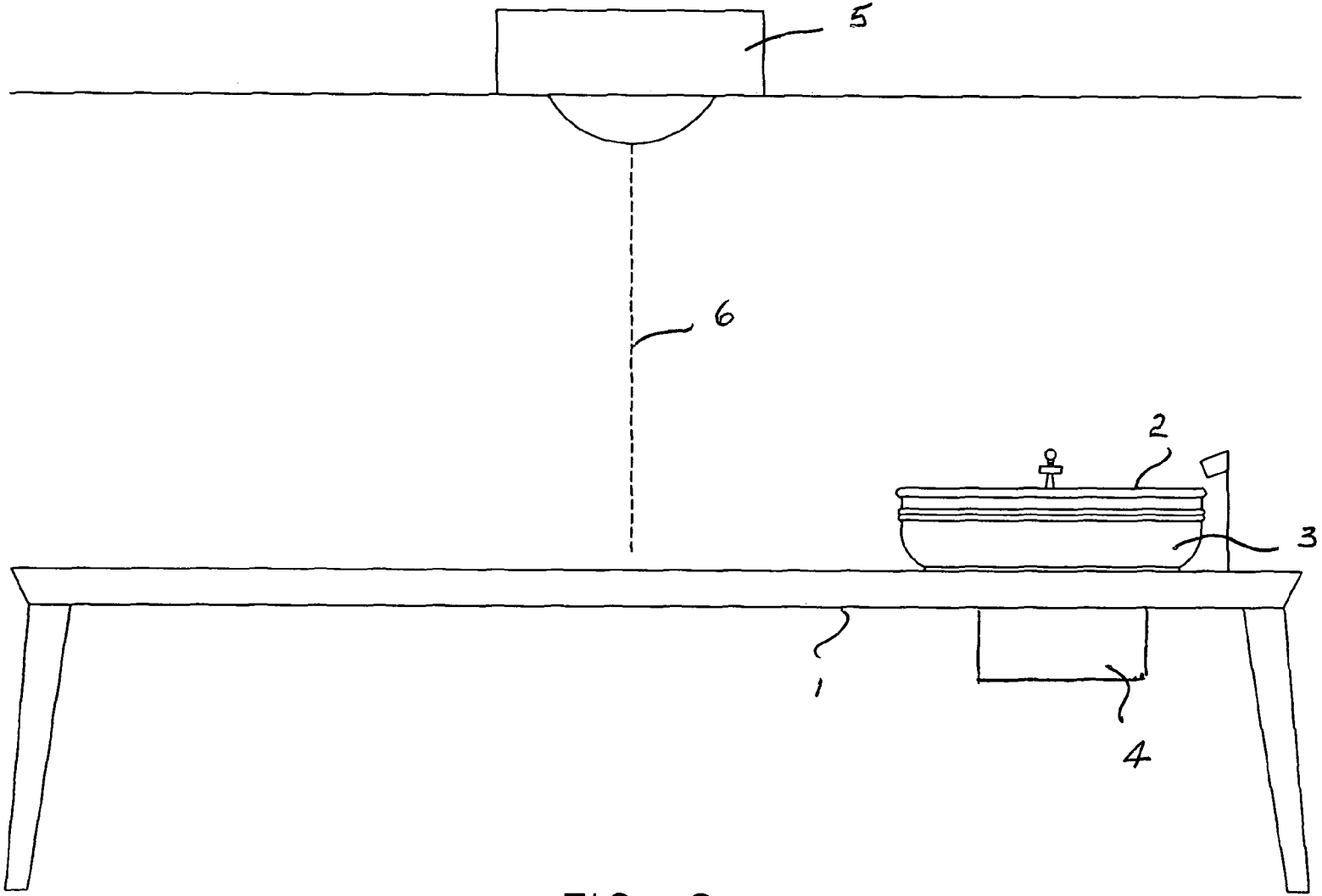
FIG. 2 is an elevational view of the roulette table and wheel of FIG. 1 as well as a portion of the game room in which such roulette table is housed and showing in particular the laser control unit of the present invention installed in the casino room ceiling and preferably visible to the players at such table.

Players choose or select with number/numbers to place their wager upon the roulette table's betting area. As the dealer or croupier D spins the roulette ball 2*a* and the roulette wheel 2, sensors 3 either positioned within the wheel or outside the wheel detect the ball speed. As the ball revolves around the wheel, players located proximal to the table, e.g., at positions 10 through 16 are placing their bets. Also while bets are being placed, the laser control unit 5 is producing a visible laser display 6 onto a designated area 8 on the roulette table 1. Low power diode laser systems are commercially available and are suitable for the present purpose, e.g., lasers in the 400 to 700 nanometer range are safe and reliable for the casino's indoor environment.

When the ball slows down to a predetermined speed, the sensor 3 will send a command via a wired connection to the display control computer 4 preferably mounted under the table 1. The display control computer will send via radio frequency or infrared wireless technology a command for "No More Bets" to the laser control unit 5. The laser control will outline via a visible beam 6 to the roulette table's betting area 7 a visible message that "No More Bets" are allowed. This message continues to be displayed until the ball permanently falls onto and rests upon the receiving cup or depression of the wheel or cage on the roulette wheel 2. When the ball falls on such a number on the wheel, the sensors 3 within said wheel sends the ball's position to the display control computer 4 within fractions of a second. The command or ball's position is then sent instantly via infrared or wireless technology to the laser control unit 5. The laser control unit then produces a visible laser beam to the game table betting area and highlights the winning number as well as all other possible winning combinations. The winning number and combinations can remain highlighted until the ball is removed or by a manual switch device.

The computer 4 may incorporate a sensor for determining the wheel's speed and the ball's position and speed relative to the wheel such that the predetermined speed at which the "No More Bets" signal should be displayed can be determined and repeated during play. Such a sensor is described in U.S. Pat. No. 5,836,583 to Towers and assigned to Technical Casino Services Ltd. of the United Kingdom and the disclosure thereof is hereby incorporated into the present Specification by such specific reference thereto. It should be apparent that the speed of the wheel and/or the speed and motion of the ball or any combination thereof can be used to determine the "predetermined speed" which triggers the above sequences. The casino management by empirical studies can make such predetermined speed and such can be varied dependent on the circumstances of the playing environment, e.g., under normal casino rules, the predetermined speed would be higher than at perhaps a charity event—the important consideration being that the predetermined speed can be varied.

A further feature that is preferably incorporated into the system of the present invention is that the laser upon the "No More Bets" announcement will illuminate the periphery 7*a*, of the betting area 7 either by a broadband-shaped circumferential beam which may pulse or by a single light beam which quickly and repeatedly circumambulates the periphery 7*a* of the betting area 7 or at least that portion thereof adjacent the players and may alternatively move back and forth along the betting area adjacent the players. This laser lighting beam effect will better enable the croupier to sense motion across the betting area periphery, e.g., caused by bettors improperly adjusting their bets by moving their hands or objects into the betting area.

The preceding system may also be accompanied by a manual system whereby all functions of operating and controlling the laser display are managed by the dealer. As the dealer places the ball on the roulette wheel, the dealer will press the display button on a custom designed keypad. The display computer will then send the message to the laser control unit. The laser control unit then, in turn, presents the display message on the gaming table. When the ball revolving around the wheel slows to the predetermined speed, the dealer will then select the "No More Bets" button on the custom keypad. This will send a command to the laser control unit to highlight the gaming area with the "No More Bets" laser display. When the ball has fallen onto a number within the roulette wheel, the dealer will select the corresponding number on the custom keypad. The laser control unit will then highlight the winning number as well as all other possible winning combinations. The laser will continue to display the winning number and combinations while the dealer is collecting the wagers and makes the payouts to the winning players. The custom keypad also has been designed with calibration and lock buttons to enable the dealer to calibrate the laser to the table layout area at anytime when necessary.

by introducing this technology, the invention will provide for a safer, fairer and add an exciting element to the age old Roulette game. The system does not introduce any physical elements that will hinder play in any way. In fact, there are no moving parts introduced to the game at all. The game remains virtually untouched. The system can also be expanded to include other table games should the casino wish to protect a specific area or zone on a gaming table.

Laser Roulette will add a new element of excitement to the Roulette gaming experience. Laser Roulette will provide for a higher level of security thus making for a more fair and honest game for both the casino and the patron. Laser Roulette will bring more new players to the roulette experience due to the system's ability to show all players the additional winning possibilities they may otherwise not be aware of. The casino is in business to provide customers with a fair and exciting gaming experience. Customers enjoying the excitement that Laser Roulette provides may stay longer at the Roulette table thereby possibly earning more winnings for themselves or the casino. Laser Roulette will provide a more positive effect on the way Roulette is played for many years to come.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A system that controls a roulette gaming table comprising a roulette wheel including:

(a) numbered and colored areas to receive a ball, (b) said table surface having a delineated area to place bets on the outcome of a each spin of the wheel, (c) a sensor to detect the speed of the wheel, or ball, or wheel and ball, (d) a computer configured to receive signals from the sensor; and (e) a laser unit disposed above the table to produce a visible laser output upon the surface of the table, so as to perform the function of establishing a predetermined speed of the wheel, or ball, or wheel and ball, such that when the speed of the wheel, or ball, or wheel and ball falls below said predetermined speed said system determines the space on which the ball will permanently come to rest at the conclusion of that spin cycle, and to utilize said sensor to signal the computer when said wheel, or ball, or wheel and ball reaches said predetermined speed to, in turn, cause said computer to signal said laser control unit which, in turn, produces a visible beam upon the surface of said table to indicate an action that may be taken, at least one of said actions to be:

i) wherein the visible laser beam outlines the perimeter of the delineated area to place bets;

ii) wherein said table includes one side where a croupier is positioned and an opposite side where players are positioned and wherein the said visible laser beam circumambulates at least that portion of the perimeter of the delineated area to place bets that is adjacent said opposite tableside where players are positioned;

iii) wherein the said laser beam displays a message on the table surface that "No More Bets" may be placed;

iv) wherein the said computer signals the laser control unit via a wireless signal;

v) wherein the computer signal the laser control unit via an infrared signal;

vi) wherein said sensor additionally determines when the ball permanently rests upon a space on the wheel and then signals the computer with such information and the computer then signals the laser control unit which, in turn, generates a visible laser display on the table announcing the winning number and combinations; and vii) wherein said table further includes an area separate from said delineated betting area upon which informational and advertising visible laser displays may be directed and directing such displays only when the wheel is either idle or when the wheel, or ball, or wheel and ball is moving at less than said predetermined speed.

2. The system of claim 1, wherein the computer additionally causes an audible message that "No More Bets" may be placed to be broadcast.

3. The system of claim 2, wherein the computer signal the croupier's tableside that "No More Bets" may be placed who, in turn, causes such message to be broadcast.

4. A roulette gaming table comprising:

(a) a roulette wheel with numbered and colored areas to receive a ball;

(b) a table surface having a delineated area to place bets on the outcome of a each spin of said wheel; and (c) a laser projection unit disposed above the table to produce a visible laser image upon said surface of the table to indicate an action that may be taken, at least one of said actions to be:

i) wherein the visible laser image outlines the perimeter of the delineated area to place bets; p2 ii) wherein said table includes one side where a croupier is positioned and an opposite side where players are positioned and wherein the said visible laser image circumambulates at least that portion of the perimeter of the delineated area to place bets that is adjacent said opposite tableside where players are positioned;

iii) wherein the said laser image displays a message on the table surface that "No More Bets" may be placed;

iv) wherein the said laser image highlights the winning number v) wherein the said laser image highlights winning combinations; and vi) wherein the said laser image displays a one or more informational or advertising message upon the surface of the table.

5. The roulette gaming table of claim 4 wherein said table further comprises:

(a) a sensor to detect the speed of the wheel and/or ball;

(b) a processing means to receive signals from said sensor; and (c) a means to control said visible laser image in accordance with said processed signals.

6. The roulette gaming table of claim 5 wherein said visible laser image further comprises one or more instructions displayed upon said surface of said table.

7. The roulette gaming table of claim 6 wherein said visible laser image contains a one or more advertising message.

8. A laser control unit configured to be interconnected with a roulette gaming table, wherein said laser control unit includes a means to produce a visible laser image upon the surface of said table to indicate an action that may be taken, at least one of said actions to be:

i) wherein the visible laser image outlines the perimeter of the delineated area to place bets;

ii) wherein said table includes one side where a croupier is positioned and an opposite side where players are positioned and wherein the said visible laser image circumambulates at least that portion of the perimeter of the delineated area to place bets that is adjacent said opposite tableside where players are positioned;

iii) wherein the said laser image displays a message on the table surface that "No More Bets" may be placed;

iv) wherein the said laser image highlights the winning number;

v) wherein the said laser image highlights winning combinations;

vi) wherein the said laser image displays a one or more instruction message; and vii) wherein the said laser image displays a one or more advertising message on the surface of the table.

9. The laser control unit of claim 8 wherein said gaming table is a roulette gaming table further comprising:

(a) a means for establishing a predetermined speed of a ball spinning on a roulette wheel on said roulette gaming table;

(b) a means for detecting the speed of said ball, or wheel, or ball and wheel;

(c) a means for receiving data indicating the speed of the wheel, or ball, or wheel and ball;

(d) a processing means for determining when said data indicates the said speed of the wheel, or ball, or wheel and ball matches said predetermined speed of said wheel, or ball, or wheel and ball; and (e) a means for controlling said visible laser image in accordance with said processing means.

10. The laser control unit of claim 8 wherein said laser control unit further comprises a means for inputting a user defined said visible laser output.

* * * * *